US009890568B2

(12) United States Patent
Stethem et al.

(10) Patent No.: US 9,890,568 B2
(45) Date of Patent: Feb. 13, 2018

(54) APPENDAGE RESTRAINT SYSTEM AND APPARATUS

(71) Applicant: Aegis Industries, Inc., Rockville, MD (US)

(72) Inventors: Kenneth J. Stethem, Rockville, MD (US); Ivo Foldyna, Rockville, MD (US); Kyle Sterling Smither, Kuna, ID (US)

( * ) Notice: Subject to any disclaimer, the term of this patent is extended or adjusted under 35 U.S.C. 154(b) by 247 days.

(21) Appl. No.: 14/616,523

(22) Filed: Feb. 6, 2015

(65) Prior Publication Data

US 2016/0230425 A1 Aug. 11, 2016

(51) Int. Cl.
*E05B 75/00* (2006.01)

(52) U.S. Cl.
CPC ..... *E05B 75/00* (2013.01)

(58) Field of Classification Search
CPC ..... E05B 75/00; B65D 63/14; Y10T 24/1498
USPC ..... 70/16–18; 128/878, 879
See application file for complete search history.

(56) References Cited

U.S. PATENT DOCUMENTS 8,739,373 B1 * 6/2014 Berman ..... A43C 7/04 24/712.6
2005/0183245 A1 * 8/2005 Whipple ..... B65D 63/14 24/129 R

FOREIGN PATENT DOCUMENTS

DE 404577 C * 10/1924 ..... B65D 63/14

* cited by examiner

*Primary Examiner* — Jack W Lavinder

(57) ABSTRACT

A restraint system has a block with a front end, a rear end, a first side, and a second side. The first and second sides are disposed between the front and rear ends. A receiving slot passes from the first side to the second side. A first locking slot and a second locking slot passes from the front end to the rear end. An elongate cable has a first and second terminus. A central portion of the cable is received in the receiving slot by passing the first terminus through the receiving slot. The first terminus is passed through the first locking slot and the second terminus is passed through the second locking slot, each from the rear end to the front end.

20 Claims, 12 Drawing Sheets

APPENDAGE RESTRAINT SYSTEM AND APPARATUS

INTRODUCTION

Handcuffs, wrist restraints, ankle restraints, and other such devices are used by military, law enforcement, and correction officers to restrain individuals in order to restrict movement and prevent assaultive behavior or escape. Commonly, handcuffs are formed of metal. Other embodiments include restraints manufactured of plastic materials such as so-called "zip ties." Certain of these devices are difficult to secure on a resisting individual, and are expensive to replace if lost, broken, or stolen.

SUMMARY

A disposable strap is a flexible material including a single figure eight-like loop forming two outer lobe sections. The opposing ends of this continuous loop pass through a lock box or block. The strap passes through a longitudinal passage from a first side of the box to a second side of the box. Each end of the strap is then inserted into one of two rear passages within the block. Within the block, each end of the strap passes through an opening in a locking plate. The opening in the locking plate is configured such that the strap can pass through from the rear of the block to the front of the block. The opening in the locking plate is also configured such that the strap cannot be withdrawn from the locking plate after insertion. In certain embodiments, the locking plate defines an opening sized so as to allow passage of the strap in either direction. Locking tines connected to the plate "bite" the strap if the strap is pulled in a direction opposite the direction of insertion, thus preventing removal. Once cuffed, the restraint can only be removed from the cuffed individual by cutting the strap.

In one aspect, the technology relates to a system having: a block having a front end, a rear end, a first side, and a second side, wherein the first side and the second side are disposed between the front end and the rear end, and wherein the block defines: a receiving slot passing from the first side to the second side; a first locking slot passing from the front end to the rear end; and a second locking slot passing from the front end to the rear end; and a single elongate cable has a first terminus and a second terminus, wherein a central portion of the single elongate cable is received in the receiving slot by passing the first terminus through the receiving slot, and wherein the first terminus is passed through the first locking slot from the rear end to the front end, and wherein the second terminus is passed through the second locking slot from the rear end to the front end. In an embodiment, the block includes a one-way locking element, wherein the one-way locking element allows movement of the single elongate cable from the rear end to the front end, but resists movement of the single elongate cable from the front end to the rear end. In another embodiment, the one-way locking element includes a plate defining an opening. In yet another embodiment, the plate has a locking projection disposed proximate the opening. In still another embodiment, the plate has a locking projection disposed remote from the opening.

In another embodiment of the above aspect, the one-way locking element includes at least two one-way locking elements, wherein a first one of the at least two locking one-way locking elements is axially aligned with the first locking slot and a second one of the at least two locking one-way locking elements is axially aligned with the second locking slot. In an embodiment, the block includes a first block portion and a second block portion, wherein at least a portion of both of the first locking slot and at least a portion of the second locking slot are defined by both of the first block portion and the second block portion. In another embodiment, the first block portion and the second block portion define a receiver for receiving the at least one locking element.

In another aspect, the technology relates to an apparatus having: a block including a front end, a rear end, a first side, and a second side, wherein the first side and the second side are disposed between the front end and the rear end, and wherein the block defines: a first slot passing from the front end to the rear end; and a second slot passing from the front end to the rear end; and a one-way locking element disposed proximate each of the first slot and the second slot, wherein each one-way locking element is adapted to lock a cable inserted into each of the first slot and the second slot. In an embodiment, each one-way locking element at least partially defines an opening substantially axially aligned with at least one of the first slot and the second slot. In another embodiment, each one-way locking element includes a resilient projection that extends towards an axis of the first slot and the second slot. In yet another embodiment, each of the one-way locking elements includes a throat disposed around the opening. In still another embodiment, the block further defines at least one receiving slot for receiving an elongate cable.

In another embodiment of the above aspect, the receiving slot passes from the first side to the second side. In an embodiment, each one-way locking element has two one-way locking elements. In another embodiment, each one-way locking element includes a substantially triangular bracket having a plurality of tines. In yet another embodiment, the plurality of tines extend into either of the first slot and the second slot. In still another embodiment, the tines are configured to deflect outward when a cable is passed in a first direction through either of the first slot and the second slot, and wherein the tines are configured to deflect inward when the cable is passed in a second direction through either of the first slot and the second slot. In yet another embodiment, deflecting inward causes the tines to bite into the cable. In still another embodiment, the block includes a unitary part.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
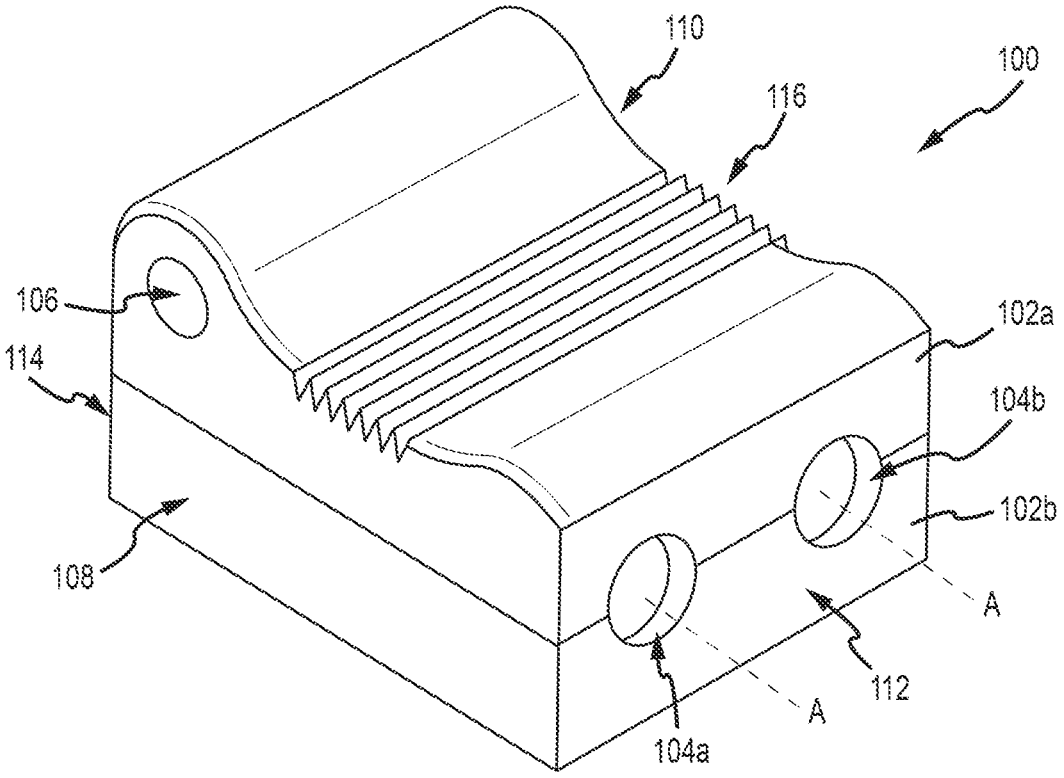
FIG. 1A depicts a perspective view of an appendage restraint apparatus.
Figure 1B:
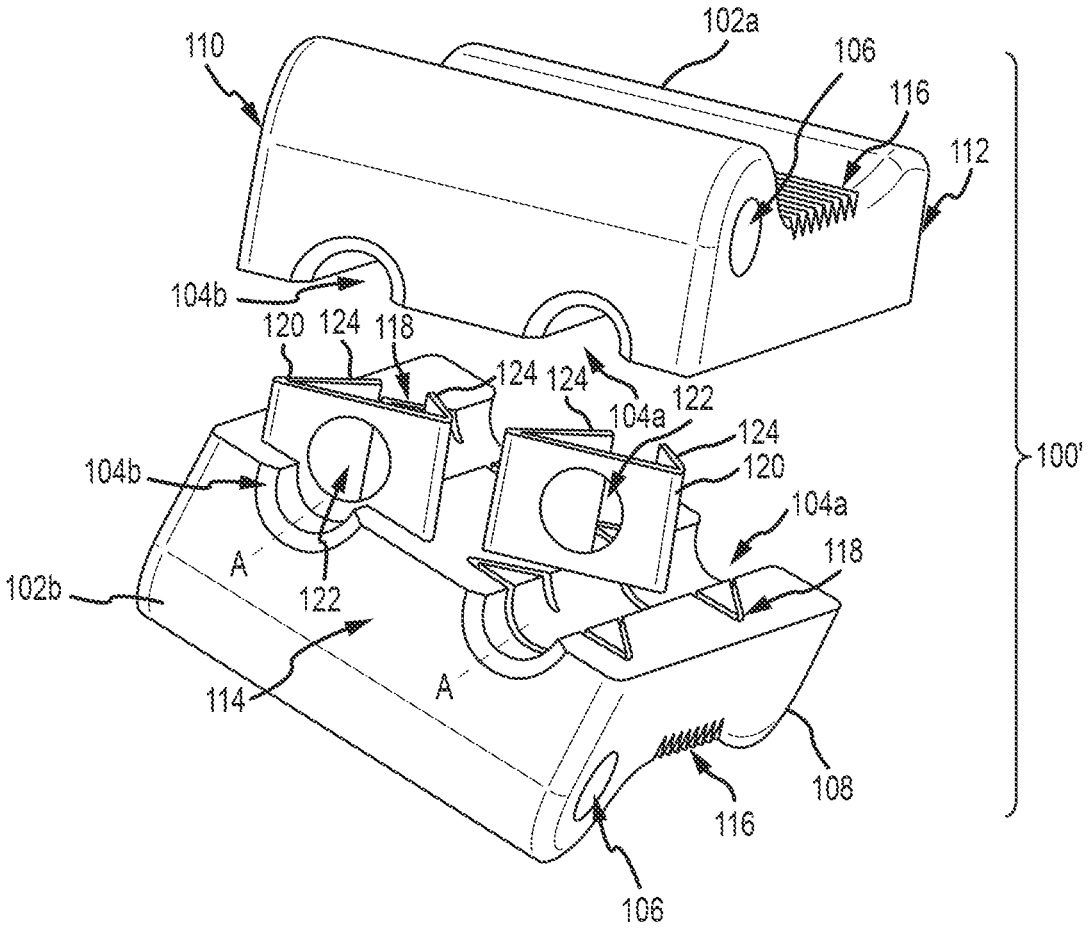
FIG. 1B depicts an exploded perspective view of another embodiment of an appendage restraint apparatus.

FIGS. 1A and 1B depict perspective view and exploded perspective views, respectively, of appendage restraint apparatuses 100, 100'. FIGS. 1A and 1B are described simultaneously. The apparatus 100, 100' may be in the shape of a block having a generally rectangular form factor, although other form factors are contemplated. In the depicted embodiment, the block 100, 100' includes two block portions 102*a*, 102*b*, which may also be referred to as an upper portion 102*a* and a lower portion 102*b*, respectively. Each block portion 102*a*, 102*b* at least partially defines a first locking slot or passage 104*a* and a second locking slot or passage 104*b*. In FIG. 1A, a receiving slot or passage 106 is defined by the upper block portion 102*a*. In FIG. 1B, however, a receiving slot 106 is defined by both the upper block portion 102*a* and the lower block portion 102*b*. Thus, in the embodiment depicted in FIG. 1B, the block portions 102*a* and 102*b* are mirror images of each other, thus reducing manufacturing costs. The receiving slot 106 extends from a first side 108 to a second side 110 of the block 100, 100'. The locking slots 104*a*, 104*b* extend from a front end 112 to a rear end 114 of the block 100, 100' and can be defined by both the upper 102*a* and lower 102*b* portions. One or more outer surfaces of the block 100, 100' may be textured 116 to allow for easy grip and manipulation of the block 100, 100' during use.

In addition to defining the locking slots 104*a*, 104*b*, the block portions 102*a*, 102*b* can also define receivers 118 for receiving one or more locking elements 120. The locking elements 120 are disposed proximate the locking slots 104*a*, 104*b*. In certain embodiments, the locking elements 120 define an opening 122 that can be aligned with an axis A of each of the locking slots 104*a*, 104*b*. In the depicted embodiment, the locking elements 120 include a plurality of locking projections or tines 124 that are described in further detail below. In the depicted embodiments, receivers 118 for two locking elements 120 are present proximate each of the two locking slots 104*a*, 104*b*. Once assembled, the two block portions 102*a*, 102*b* can be secured together with an adhesive, one or more fasteners, or other securement elements.

FIGS. 2A-2D depict sectional views of an appendage restraint system 200 that includes a block 202 and a single cable 204. Only one portion of the block 202 is depicted. The block 202 at least partially defines a first locking slot or passage 206*a* and a second locking slot or passage 206*b*. Each locking slot 206*a*, 206*b* extends from a rear end 208 to a front end 210 of the block 202. Two one-way locking elements 212 are disposed in each of the locking slots 206*a*, 206*b*. In the depicted embodiment, the locking elements 212 are substantially triangular-shaped and include a base 214 and a plurality of tines 216 located remotely therefrom. The base 214 defines an opening 218 substantially aligned with an axis A of the locking slots 206*a*, 206*b*. The tines 216 are resilient and project towards the axis A, so as to deflect outward when the cable 204 is inserted into the locking slots 206*a*, 206*b* as described below. The tines 216 deflect inward, however, when the cable 204 is pulled in the opposite direction thus locking the cable 204 in place. The block 202 also defines a receiving slot 220 that passes from a first side 222 to a second side 224 of the block 202. In the depicted embodiment, the receiving slot 220 is disposed so as not to intersect either of the locking slots 206*a*, 206*b*. In other embodiments, the receiving slot 220 may intersect one or more of the locking slots 206*a*, 206*b*, provided the intersection does not cause interference with movement of the cable 204 contained therein.

Figure 2A:
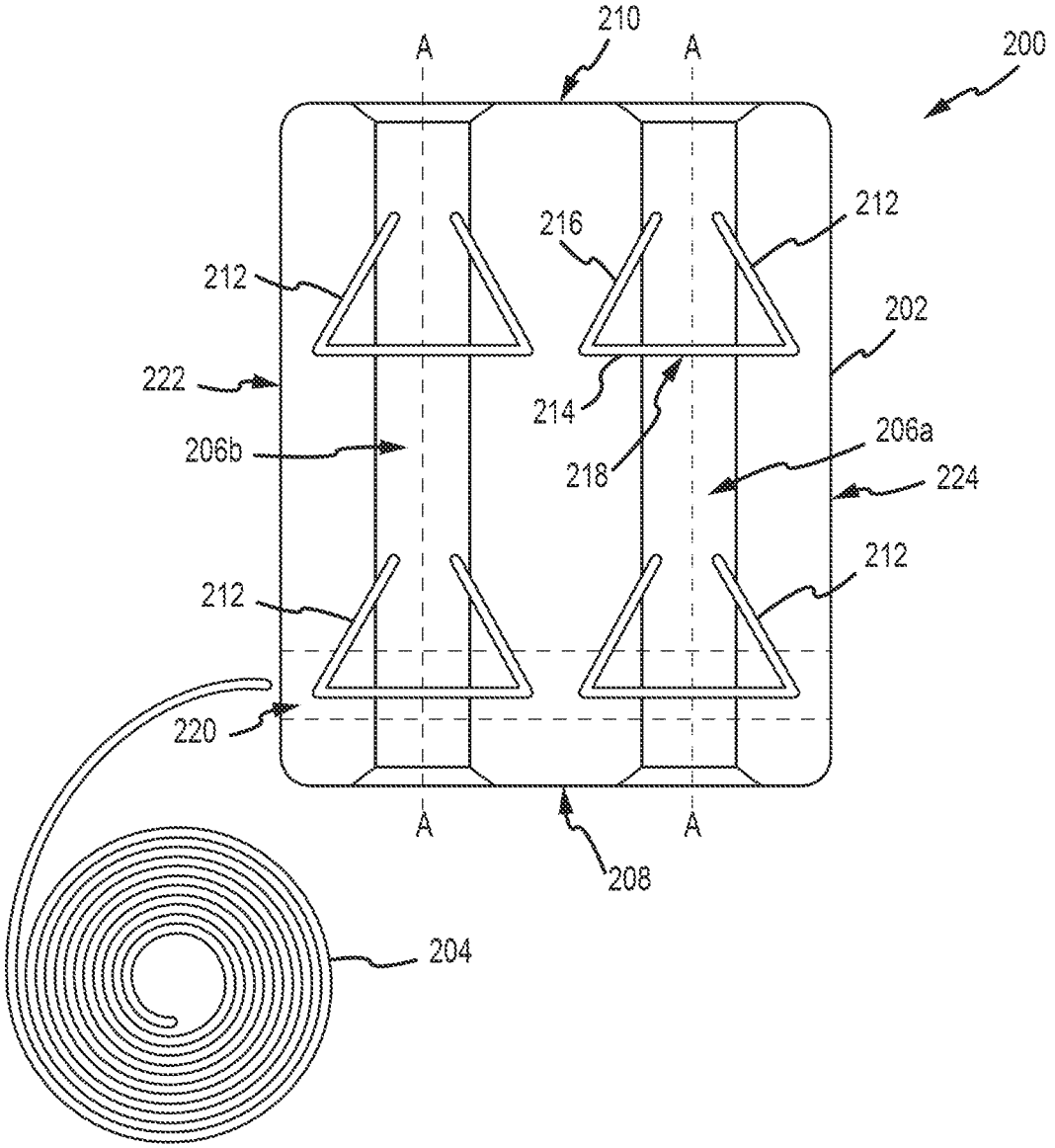
FIGS. 2A-2D depict sectional views of an appendage restraint system.
Figure 2B:
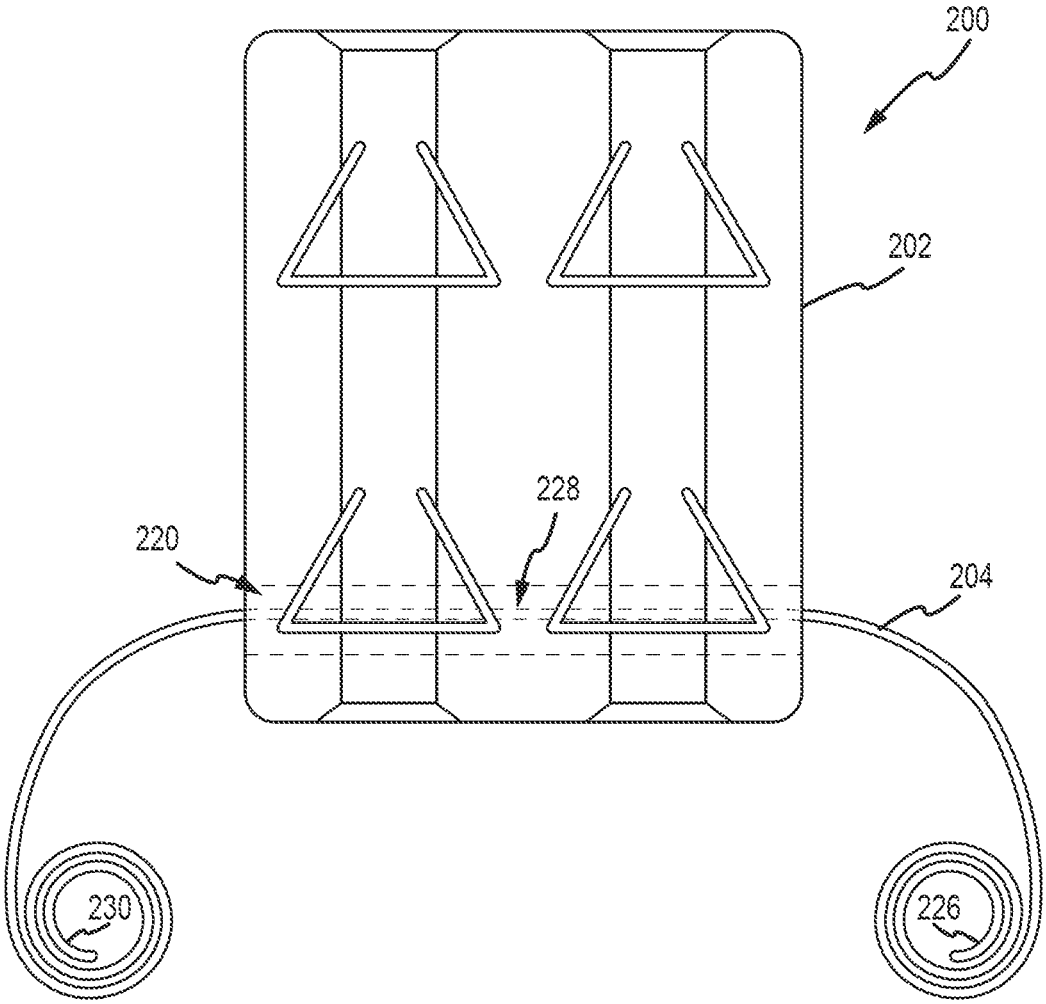

FIG. 2B depicts the appendage restraint system 200 after a first terminus 226 of the cable 204 has been inserted into the receiving slot 220. After complete passage of the first terminus 226 through the receiving slot 220, a central portion 228 of the cable 204 remains in the receiving slot 220, and due to the dimensions thereof, is able to move freely back and forth in the receiving slot 220. Alternatively, a second terminus 230 of the cable 204 can be inserted into the receiving slot 220 such that the central portion 228 remains.

Figure 2C:
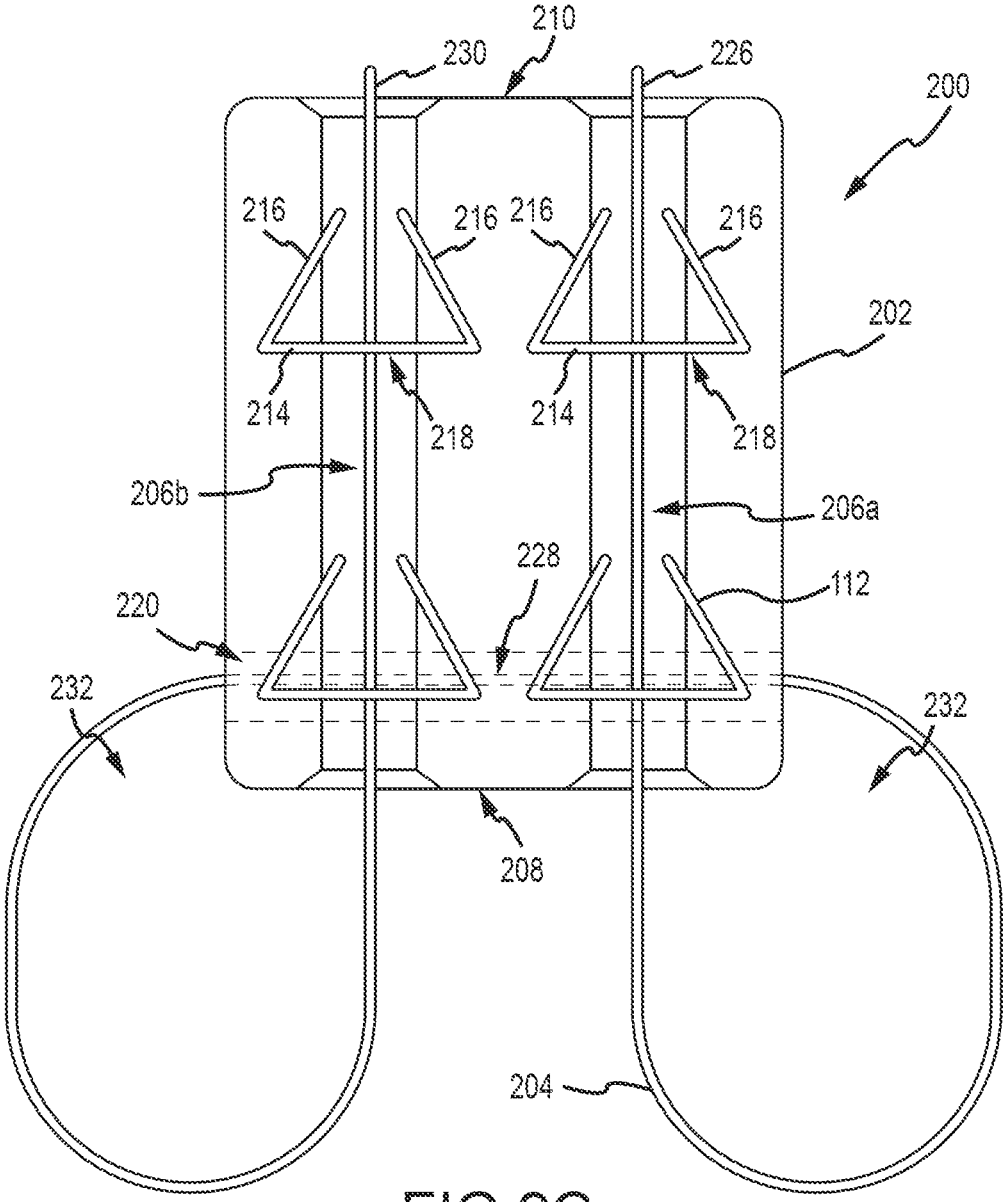

FIG. 2C depicts the appendage restraint system 200 after the first terminus 226 of the cable 204 has been inserted into the first locking slot 206*a* and the second terminus 230 has been inserted into the second locking slot 206*b* the receiving slot 220. As depicted, each of the first terminus 226 and the second terminus 230 are inserted from a rear end 208 of the block 202 toward a front end 210 of the block 202. Once inserted, the cable 204 forms two loops 232 into which can be inserted appendages (wrists, arms, ankles, legs, fingers, toes) of a subject (a person or animal) so as to restrain that subject. Additionally, multiple subjects may be secured to each other, having one appendage each disposed in one loop 232.

Figure 2D:
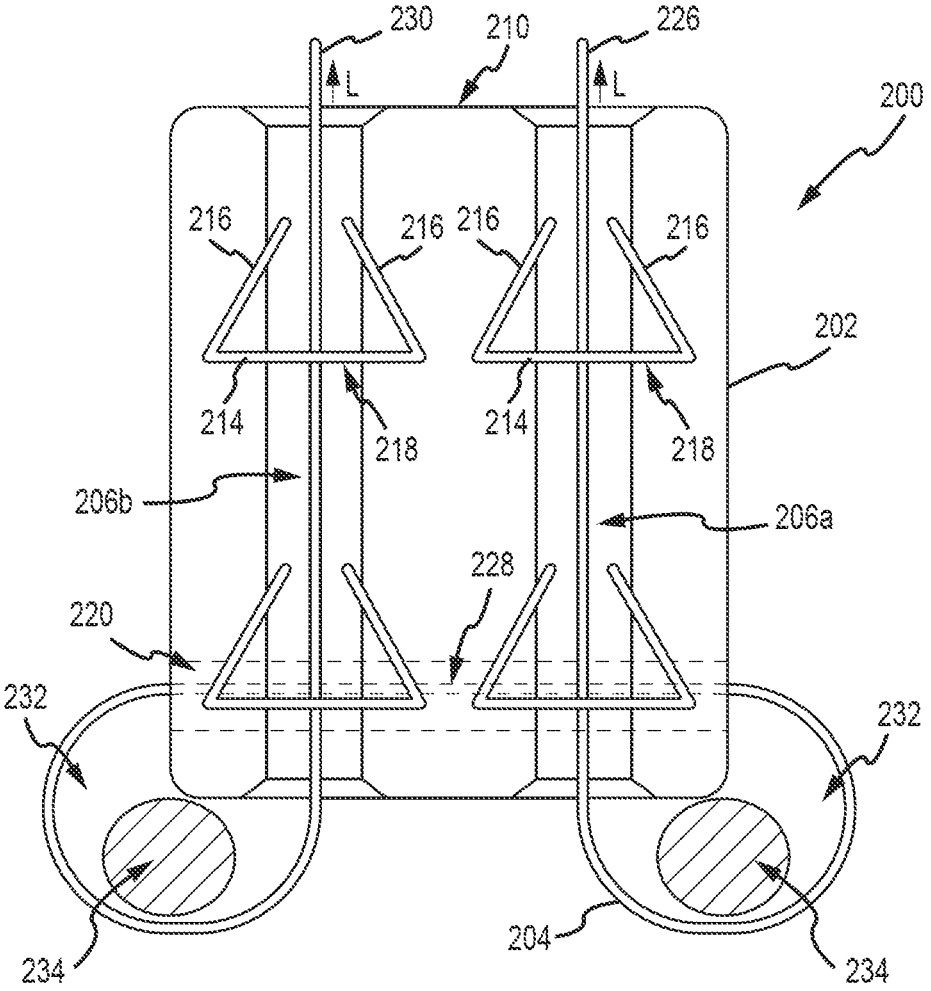

In FIG. 2D depicts the appendage restraint system 200 after appendages 234 have been inserted into the loops 232 and tightened so as to restrain a subject. The loops 232 are tightened by pulling the first terminus 226 and the second terminus 230 away from the front end 210 of the block 202 in the locking direction L. Of course, each loop 232 can be individually tightened as required or desired. The cable 204 is free to pass in the locking direction L through the openings 218 in the locking elements 214. When pulled in an opposite direction, however (e.g., as the restrained subject tries to resist to free themselves), the tines 216 of the locking elements 214 bite into the cable 204, preventing movement of the cable 204 in a direction opposite the locking direction L. Thus, to be released from the appendage restraint system 200, the cable 204 must be cut proximate the loops 232. The portions of the cable 204 connected to the first terminus 226 and the second terminus 230 can be pulled through the locking slots 206*a*, 206*b* in the locking direction L, while the central portion 228 of the cable may be pulled in either direction from the receiving slot 220. The block 202 can then be reused utilizing a new cable.

Figure 3:
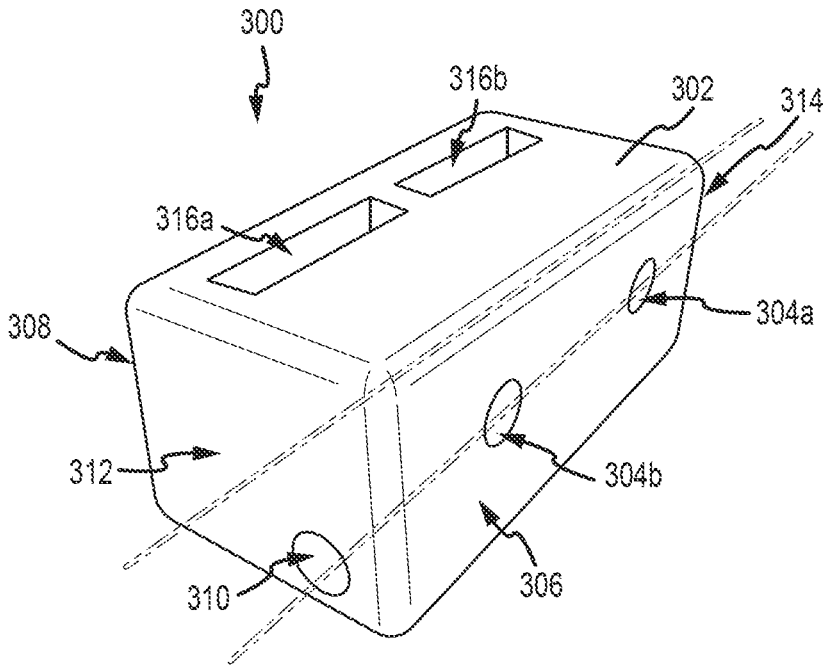
FIG. 3 depicts a perspective view of another embodiment of an appendage restraint apparatus.
Figure 4:
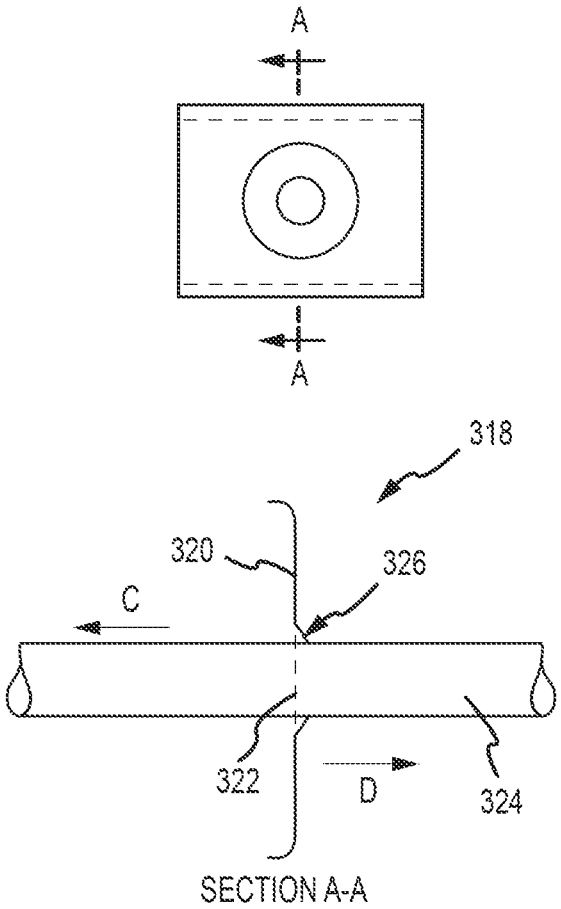
FIG. 4 depicts a side sectional view of a locking element utilized in an appendage restraint apparatus.

FIG. 3 depicts a perspective view of another embodiment of an appendage restraint apparatus 300. The apparatus 300 is in the form factor of a block 302 that may be a unitary part that defines a number of passages. Two locking passages 304*a*, 304*b* extend from a rear end 306 to a front end 308 of the block 302. Additionally, a receiving passage 310 extends from a first side 312 to a second side 314 of the block 302. The block 302 also defines two receivers 316*a*, 316*b* that are sized to each receive a locking element in the form of a plate. FIG. 4 depicts a side sectional view of such a locking element 318. The locking element 318 is in a form factor of a plate 320 that defines an opening 322 sized to allow passage of a cable 324. Proximate the opening 322 can be one or more locking element tines, as depicted in the embodiments above. In the depicted embodiment, however, the opening 322 forms a throat 326 around the circumference of the opening 322. The throat 326 is sized so as to allow passage of the cable 324 in a first direction D, due to pulling or pushing of the cable 324, as described above. A counterforce C applied to the cable 324, however, causes the throat 326 to pinch or bite the cable 324, preventing further movement in the direction of counterforce C.

Returning to FIG. 3, a variety of locking plates may be utilized in the depicted apparatus 300. For example, the locking passages 304*a*, 304*b* may be sized to accommodate a maximum cable diameter. Various locking plates having openings sized to accommodate a variety of cables of different diameters may be interchangeably utilized in the apparatus 300. For example, locking plates having openings configured to accommodate cables having diameters of about _mm, _mm, or _mm may be selectively inserted into the apparatus 300. After insertion, the locking plates may be removably or permanently fixed in the receivers 316*a*, 316*b*, and an appropriately sized cable can be utilized to secure a subject.

Figure 5:
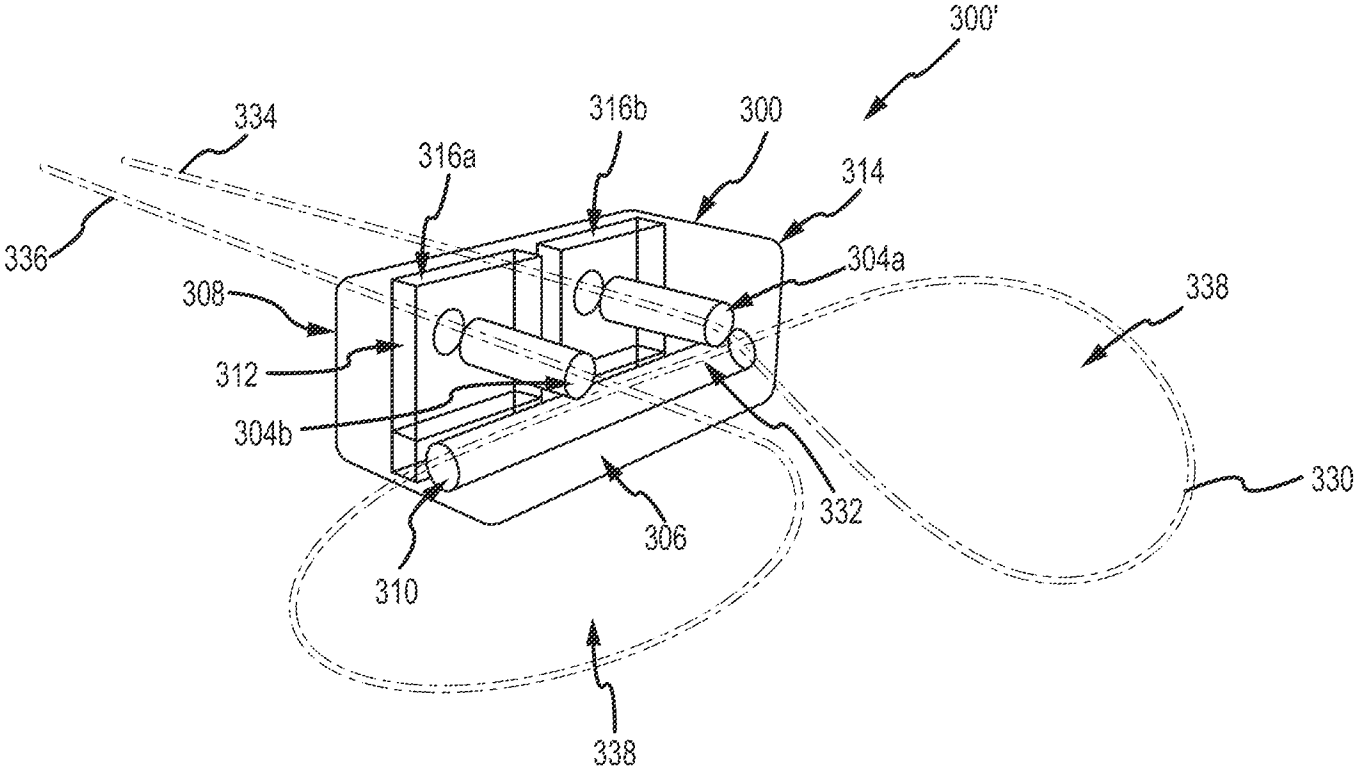
FIG. 5 depicts a perspective view of an appendage restraint system utilizing the appendage restraint apparatus of FIG. 3.

FIG. 5 depicts a perspective view of an appendage restraint system 300' utilizing the appendage restraint apparatus 300 of FIG. 3. Many of the components of the apparatus 300 are described above with regard to FIG. 3 and are therefore not necessarily described further. The system 300' includes a cable 330 having a central portion 332 thereof inserted into the receiving passage 310. A first terminus 334 is inserted into a first passage 304*a* of the two locking passages and a second terminus 336 is inserted into a second passage 306*b* of the two locking passages. This forms two loops 338 that are configured to receive and tighten around appendages of a subject. The locking plates (not shown) contained in the receivers 316*a*, 316*b* allow movement of the cable from a rear end 306 to a front end 308 of the block 302, but resist such movement in the opposite direction.

Embodiments of appendage restraint systems depicted in the figures above share certain common structures. For example, the receiving slots are parallel to each other and provide locking force on a cable in the same direction (e.g., front end-to-rear end). This can provide an advantage in that both of the first terminus and the second terminus of the cable can be drawn tight simultaneously. Additionally, a receiving slot is disposed so as to span the block from a first side to a second side. This receiving slot is disposed on the same side of the locking slots, but also be otherwise oriented within the block. Other embodiments of appendage restraint systems having different structure are contemplated. Certain such embodiments are depicted in FIGS. 6A-6C.

Figure 6A:
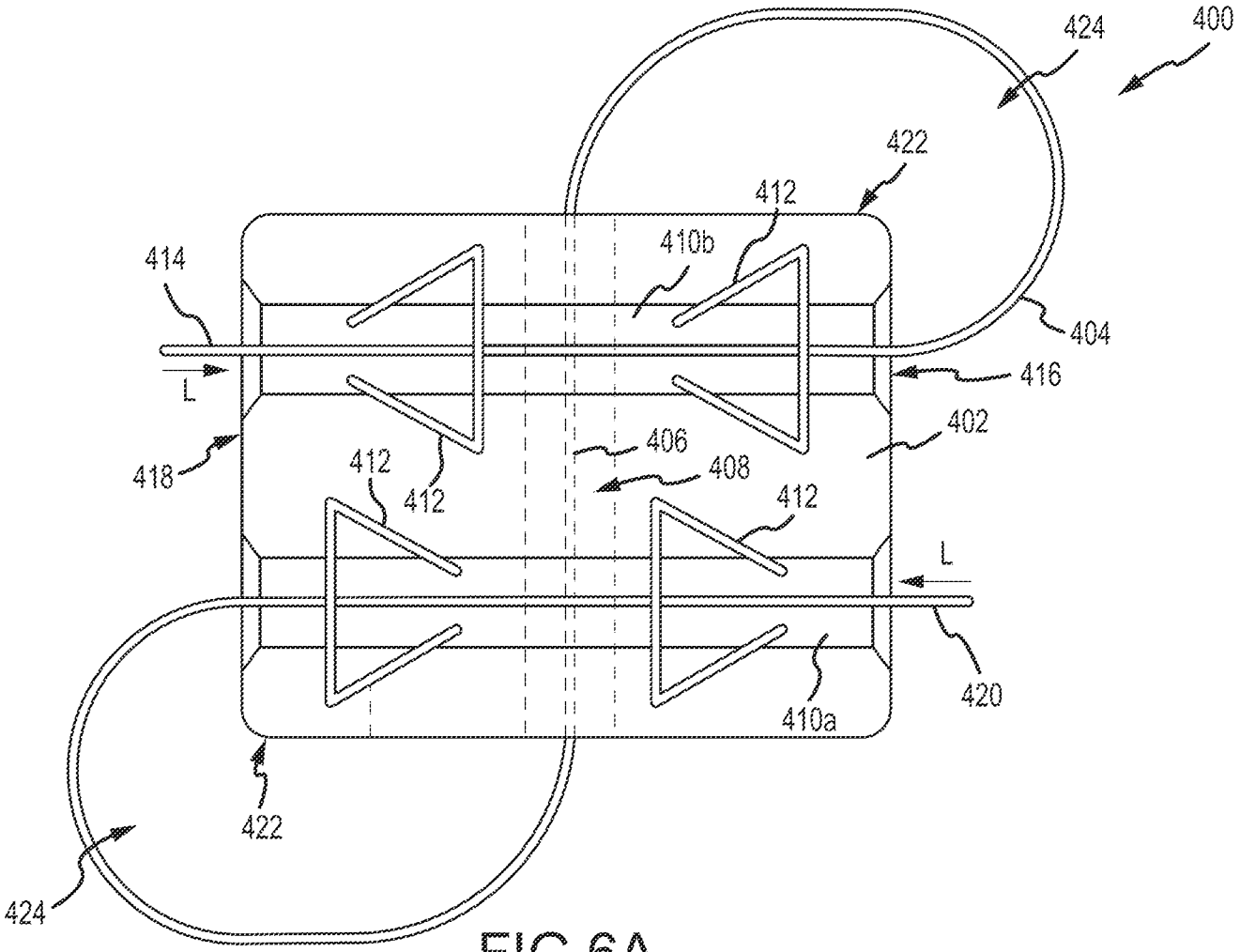
FIGS. 6A-6C depict various views of other embodiments of an appendage restraint systems.

FIG. 6A, for example, depicts a sectional view of an appendage restraint system 400 including a block 402. The block 402 is depicted having a substantially rectangular form factor for ease of presentation, but other shapes are contemplated. In the depicted embodiment, a cable 404 includes a central portion 406 that is received in a receiving passage 408 disposed on one side of two locking passages 410*a*, 410*b*. Locking elements 412 in each locking passage 410*a*, 410*b* are oriented in opposing directions, such that the locking directions L are opposite each other in each locking passage 410*a*, 410*b*. Thus, a first terminus 414 can be freely inserted from a front end 416 to a rear end 418 of the block 402, while a second terminus 420 may be freely inserted from the rear end 418 to the front end 416. In this or any embodiment, it may be desirable to round or chamfer corners 422 of the block 402 so as to reduce potential discomfort sharp edges may produce on appendages that are secured in loops 424.

Figure 6B:
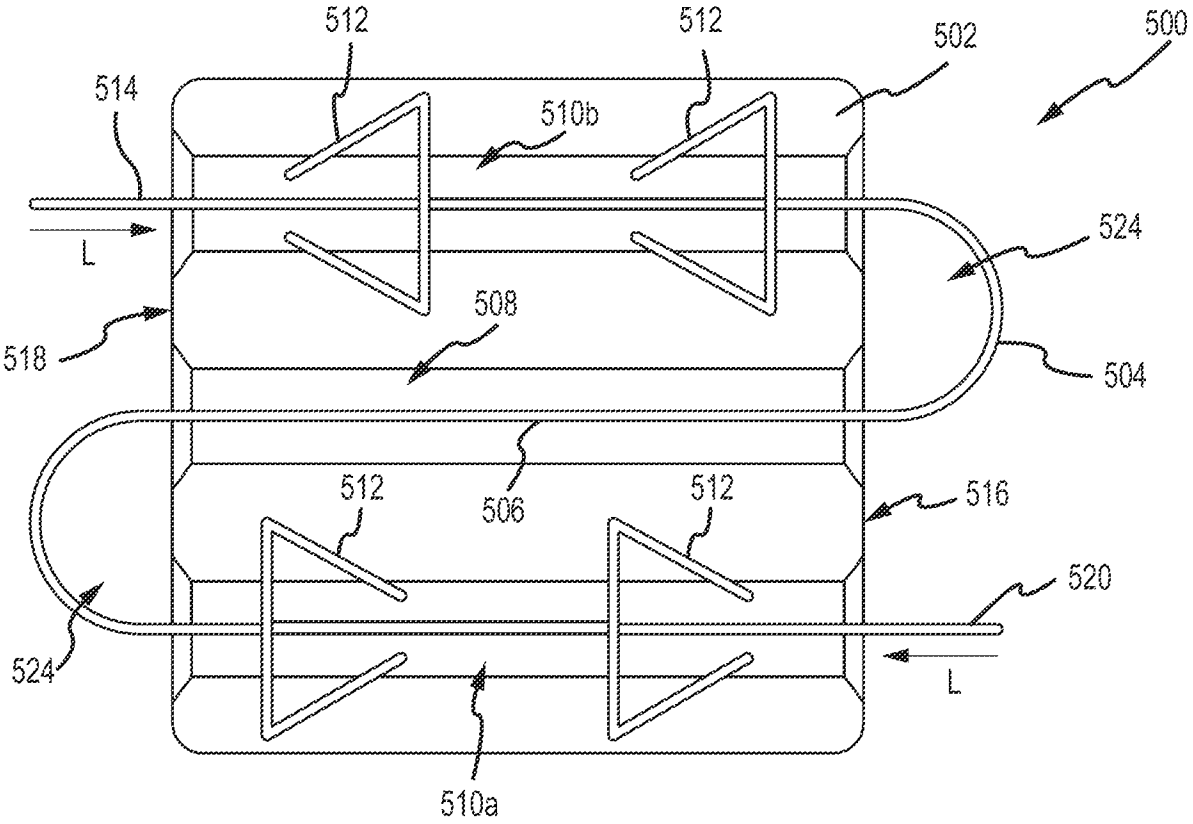

FIG. 6B depicts a sectional view of an appendage restraint system 500 including a block 502. The block 502 is depicted having a substantially rectangular form factor for ease of presentation, but other shapes are contemplated. In the depicted embodiment, a cable 504 includes a central portion 506 that is received in a receiving passage 508 disposed between and substantially coplanar with two locking passages 510*a*, 510*b*. Locking elements 512 in each locking passage 510*a*, 510*b* are oriented in opposing directions, such that the locking directions L are opposite each other in each locking passage 510*a*, 510*b*. Thus, a first terminus 514 can be freely inserted from a front end 516 to a rear end 518 of the block 502, while a second terminus 520 may be freely inserted from the rear end 518 to the front end 516. Appendages may be secured in loops 524.

Figure 6C:
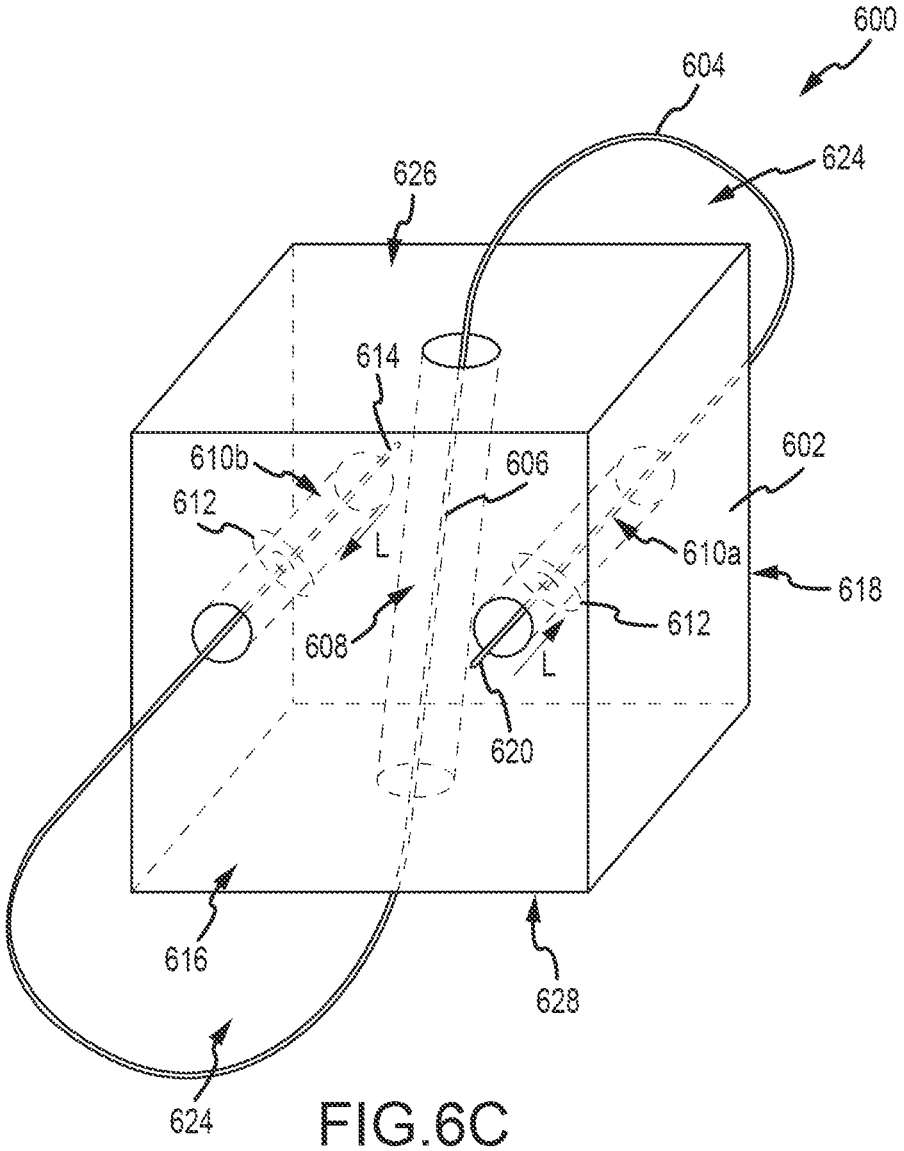

FIG. 6C depicts a perspective view of an appendage restraint system 600 including a block 602. The block 602 is depicted having a substantially cubic form factor for ease of presentation, but other shapes are contemplated. In the depicted embodiment, a cable 604 includes a central portion 606 that is received in a receiving passage 608 extending from a top surface 626 to a bottom surface 628 of the block 602. The receiving passage 608 disposed between two locking passages 610*a*, 610*b*. Locking elements 612 in each locking passage 610*a*, 610*b* are oriented in opposing directions, such that the locking directions L are opposite each other in each locking passage 610*a*, 610*b*. Thus, a first terminus 614 can be freely inserted from a front end 616 to a rear end 618 of the block 602, while a second terminus 620 may be freely inserted from the rear end 618 to the front end 616. Appendages may be secured in loops 624.

Different types of materials may be used for both the block and cable depending on application and expected use of the system. For example, nylon cable may be utilized. Other materials may include polyethylene or other robust plastics. The block may be made of plastic or metal, or a combination thereof (i.e., a plastic overmolded onto a metal core). Hollow or solid materials may be utilized. Acceptable plastics may include PVC, ABS, or fiber-reinforced plastics. Acceptable metals may include steel, aluminum, or other materials. These are merely exemplary and may be modified as required or desired for a particular application.

Additionally, appendage restraint systems utilizing multiple cables are also contemplated. For example, for the embodiment depicted in FIG. 1B, two cables may each be knotted at a first end. The unknotted ends may then be inserted into one of the depicted receiving slots 106, then into one of the locking slots 104*a*, 104*b* to form two loops to secure appendages.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A system comprising:

a block comprising a front end, a rear end, a first side, and a second side, wherein the first side and the second side are disposed between the front end and the rear end, and wherein the block defines:

a receiving slot passing from the first side to the second side;

a first locking slot passing from the front end to the rear end; and a second locking slot passing from the front end to the rear end; and a single elongate cable comprising a first terminus and a second terminus, wherein a central portion of the single elongate cable is received in the receiving slot by passing the first terminus through the receiving slot, and wherein the first terminus is passed through the first locking slot from the rear end to the front end, and wherein the second terminus is passed through the second locking slot from the rear end to the front end, wherein the block comprises a one-way locking element, wherein the one-way locking element allows movement of the single elongate cable from the rear end to the front end, but resists movement of the single elongate cable from the front end to the rear end.

2. The system of claim 1, wherein the one-way locking element comprises a plate defining an opening.

3. The system of claim 2, wherein the plate comprises a locking projection disposed proximate the opening.

4. The system of claim 2, wherein the plate comprises a locking projection disposed remote from the opening.

5. The system of claim 2, wherein the block comprises a first block portion and a second block portion, wherein at least a portion of both of the first locking slot and at least a portion of the second locking slot are defined by both of the first block portion and the second block portion.

6. The system of claim 5, wherein each of the first block portion and the second block portion define a receiver for receiving the at least one locking element.

7. The system of claim 1, wherein the one-way locking element comprises at least two one-way locking elements, wherein a first one of the at least two locking one-way locking elements is axially aligned with the first locking slot and a second one of the at least two locking one-way locking elements is axially aligned with the second locking slot.

8. An apparatus comprising:

a block comprising a front end, a rear end, a first side, and a second side, wherein the first side and the second side are disposed between the front end and the rear end, and wherein the block defines:

a first slot passing from the front end to the rear end; and a second slot passing from the front end to the rear end; and a one-way locking element disposed proximate each of the first slot and the second slot, wherein the one-way locking element is adapted to lock a cable inserted into each of the first slot and the second slot, wherein the one-way locking element comprises a substantially triangular bracket comprising a plurality of tines.

9. The apparatus of claim 8, wherein each one-way locking element at least partially defines an opening substantially axially aligned with at least one of the first slot and the second slot.

10. The apparatus of claim 9, wherein each one-way locking element comprises a resilient projection that extends towards an axis of the first slot and the second slot.

11. The apparatus of claim 10, wherein the of the one-way locking elements comprises a throat disposed around the opening.

12. The apparatus of claim 8, wherein the one-way locking element comprises two one-way locking elements.

13. The apparatus of claim 8, wherein the plurality of tines extend into either of the first slot and the second slot.

14. The apparatus of claim 13, wherein the tines are configured to deflect outward when a cable is passed in a first direction through either of the first slot and the second slot, and wherein the tines are configured to deflect inward when the cable is passed in a second direction through either of the first slot and the second slot.

15. The apparatus of claim 14, wherein deflecting inward causes the tines to bite into the cable.

16. The apparatus of claim 8, wherein the block comprises a unitary part.

17. An apparatus comprising:

a block comprising a front end, a rear end, a first side, and a second side, wherein the first side and the second side are disposed between the front end and the rear end, wherein the block further defines at least one receiving slot, passing from the first side to the second side, for receiving an elongate cable, and wherein the block defines:

a first slot passing from the front end to the rear end; and a second slot passing from the front end to the rear end; and a one-way locking element disposed proximate each of the first slot and the second slot, wherein the one-way locking element is adapted to lock a cable inserted into each of the first slot and the second slot.

18. The apparatus of claim 17, wherein the locking element comprises a plurality of tines, wherein the plurality of tines extend into either of the first slot and the second slot.

19. The apparatus of claim 18, wherein the tines are configured to deflect outward when a cable is passed in a first direction through either of the first slot and the second slot, and wherein the tines are configured to deflect inward when the cable is passed in a second direction through either of the first slot and the second slot.

20. The apparatus of claim 19, wherein deflecting inward causes the tines to bite into the cable.

* * * * *